US011802726B2

(12) United States Patent
Matsuo et al.

(10) Patent No.: US 11,802,726 B2
(45) Date of Patent: Oct. 31, 2023

(54) REFRIGERATION CYCLE DEVICE

(71) Applicant: Mitsubishi Electric Corporation, Tokyo (JP)

(72) Inventors: Tsuyoshi Matsuo, Tokyo (JP); Masafumi Tomita, Tokyo (JP); Mizuo Sakai, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 332 days.

(21) Appl. No.: 17/272,538

(22) PCT Filed: Dec. 6, 2018

(86) PCT No.: PCT/JP2018/044986
§ 371 (c)(1),
(2) Date: Mar. 1, 2021

(87) PCT Pub. No.: WO2020/115878
PCT Pub. Date: Jun. 11, 2020

(65) Prior Publication Data

US 2021/0325097 A1 Oct. 21, 2021

(51) Int. Cl.
*F25B 49/00* (2006.01)
*F25B 49/02* (2006.01)

(52) U.S. Cl.
CPC ..... *F25B 49/022* (2013.01); *F25B 2600/027* (2013.01); *F25B 2700/1931* (2013.01); *F25B 2700/1933* (2013.01)

(58) Field of Classification Search
CPC ..... F25B 49/022; F25B 2600/027; F25B 2700/1931; F25B 2700/1933
See application file for complete search history.

(56) References Cited

U.S. PATENT DOCUMENTS 6,321,543 B1 * 11/2001 Said ..... F25B 49/022 62/81

FOREIGN PATENT DOCUMENTS

| | | | | |
|---|---|---|---|---|
| JP | H04-273949 A | 9/1992 | | |
| WO | 2016/009559 A1 | 1/2016 | | |
| WO | WO-2016009559 A1 * | 1/2016 | ..... | F25B 1/00 |

OTHER PUBLICATIONS

Abe, Refrigeration Cycle Device, Jan. 21, 2016, WO2016009559A1, Whole Document (Year: 2016).*

(Continued)

*Primary Examiner* — Larry L Furdge
(74) *Attorney, Agent, or Firm* — POSZ LAW GROUP, PLC

(57) ABSTRACT

A refrigeration cycle device includes a compressor to compress refrigerant, a suction-side detector to detect a pressure of the refrigerant to be suctioned into the compressor, a discharge-side detector to detect a pressure of the refrigerant discharged from the compressor, and controlling circuitry that controls the compressor. When the ratio of a second pressure value detected by the discharge-side detector to a first pressure value detected by the suction-side detector is not between a predetermined upper limit and a predetermined lower limit, the controlling circuitry controls the compressor such that the ratio falls between the predetermined upper limit and the predetermined lower limit.

3 Claims, 6 Drawing Sheets

(56) References Cited

OTHER PUBLICATIONS

International Search Report of the International Searching Authority dated Feb. 12, 2019 for the corresponding International application No. PCT/JP2018/044986 (and English translation).

* cited by examiner

REFRIGERATION CYCLE DEVICE

CROSS REFERENCE TO RELATED APPLICATION

This application is a U.S. national stage application of International Patent Application No. PCT/JP2018/044986 filed on Dec. 6, 2018, the disclosure of which is incorporated herein by reference.

TECHNICAL FIELD

The present invention relates to a refrigeration cycle device to be used, for example, for an air conditioner.

BACKGROUND

There is a conventionally-known refrigeration cycle device that controls a compressor on the basis of the ratio of the pressure of refrigerant discharged from the compressor to the pressure of refrigerant to be suctioned into the compressor (see, for example, Patent Literature 1). When the ratio described above is equal to or higher than a set value, the conventional refrigeration cycle device forcibly reduces the running frequency of the compressor to protect the compressor.

PATENT LITERATURE

Patent Literature 1: Japanese Patent Application Laid-open No. H4-273949

However, when the ratio described above is reduced, the conventional refrigeration cycle device cannot properly perform differential-pressure oil supply to the compressor. There is thus a risk that a bearing or a sliding portion of the compressor may be worn. The wear of the bearing or the sliding portion of the compressor degrades the performance of the compressor. Furthermore, this leads to damage of the compressor.

SUMMARY

The present invention has been achieved to solve the above problems, and an object of the present invention is to provide a refrigeration cycle device that makes it possible to properly perform differential-pressure oil supply to a compressor.

In order to solve the above problem and achieve the object, a refrigeration cycle device according to the present invention includes a compressor to compress refrigerant; a suction-side detector to detect a pressure of the refrigerant to be suctioned into the compressor; a discharge-side detector to detect a pressure of the refrigerant discharged from the compressor; and a control device having a function of controlling the compressor when a ratio of a second pressure value detected by the discharge-side detector to a first pressure value detected by the suction-side detector is not between a predetermined upper limit and a predetermined lower limit, such that the ratio falls between the upper limit and the lower limit. The control device does not control a running frequency of the compressor when the ratio is between the upper limit and an upper-limit-side second reference value, or when the ratio is between the lower limit and a lower-limit-side second reference value, the upper-limit-side second reference value being smaller than the upper limit and larger than the lower limit, and the lower-limit-side second reference value being larger than the lower limit and smaller than the upper-limit-side second reference value.

The refrigeration cycle device according to the present invention has an effect where it is possible to properly perform differential-pressure oil supply to a compressor.

DETAILED DESCRIPTION

A refrigeration cycle device according to embodiments of the present invention will be described in detail below with reference to the accompanying drawings. The present invention is not limited to the embodiments.

First embodiment.

Figure 1:
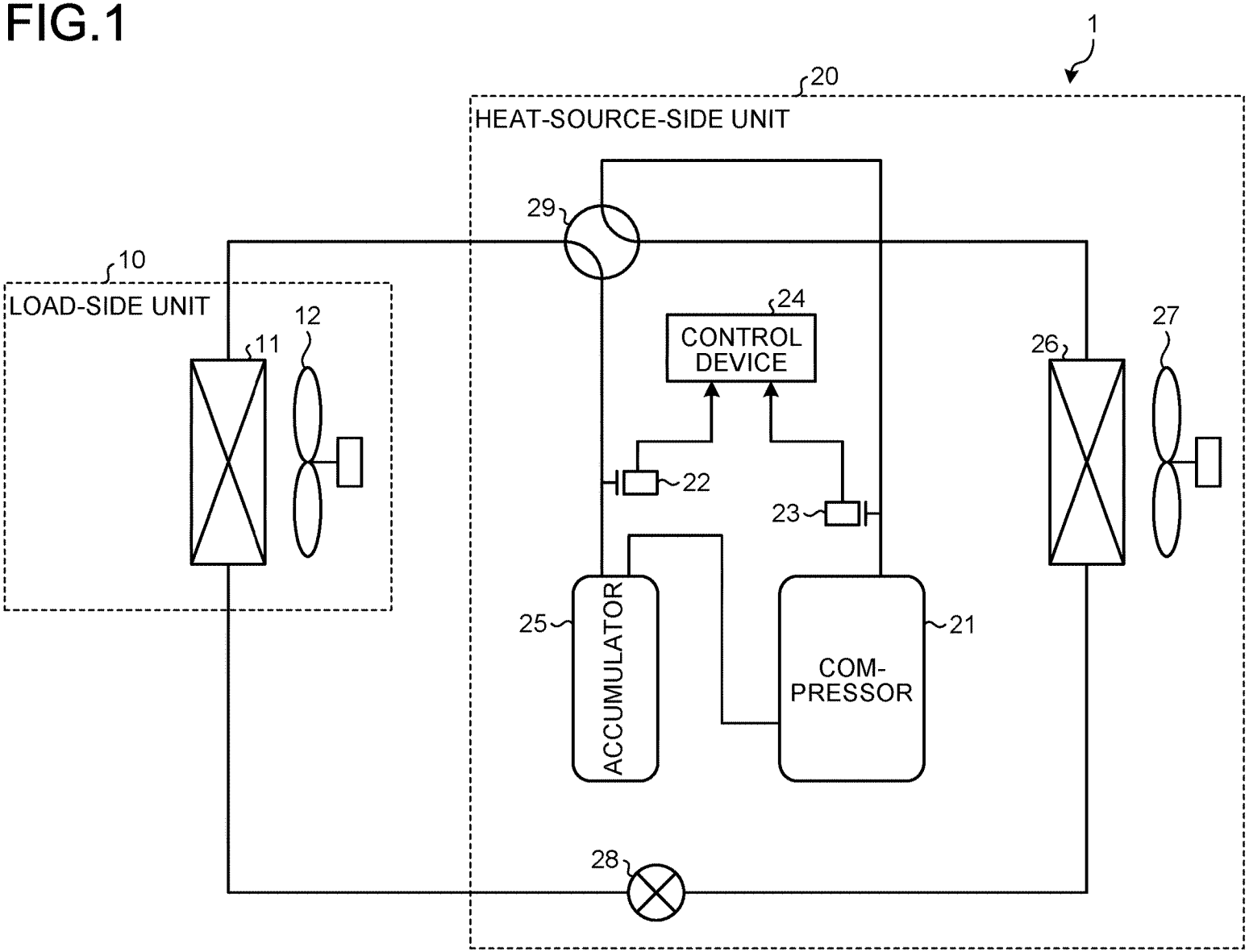
FIG. 1 is a diagram illustrating a configuration of a refrigeration cycle device according to a first embodiment.

FIG. 1 is a diagram illustrating a configuration of a refrigeration cycle device 1 according to a first embodiment. The refrigeration cycle device 1 is, for example, an air conditioner that performs air conditioning in a room that is a target to be air-conditioned. The refrigeration cycle device 1 includes a load-side unit 10 and a heat-source-side unit 20. The load-side unit 10 is, for example, an indoor unit installed in a room. The heat-source-side unit 20 is, for example, an outdoor unit installed outdoors.

The load-side unit 10 includes a load-side heat exchanger 11 that exchanges heat between refrigerant and air in a room, and a load-side blower 12 that delivers air in the room to the load-side heat exchanger 11. A fan is an example of the load-side blower 12.

The heat-source-side unit 20 includes a compressor 21 that compresses refrigerant to bring the refrigerant into a relatively high-temperature high-pressure state. For example, the compressor 21 is a variable-capacity compressor. In the first embodiment, the compressor 21 is an inverter compressor including an inverter circuit and a compressor motor. The heat-source-side unit 20 further includes a suction-side detector 22 that detects a pressure of refrigerant to be suctioned into the compressor 21, and a discharge-side detector 23 that detects a pressure of refrigerant discharged from the compressor 21. A value of the pressure detected by the suction-side detector 22 is defined as a first pressure value. A value of the pressure detected by the discharge-side detector 23 is defined as a second pressure value. In general, the first pressure value is smaller than the second pressure value.

The heat-source-side unit 20 further includes a control device 24 having a function of obtaining first information that indicates the first pressure value detected by the suction-side detector 22 from the suction-side detector 22, obtaining second information that indicates the second pressure value detected by the discharge-side detector 23 from the discharge-side detector 23, and controlling the compressor 21 on the basis of the first pressure value and the second pressure value.

Specifically, the control device 24 has a function of controlling the compressor 21 when the ratio of the second pressure value to the first pressure value is not between a predetermined upper limit and a predetermined lower limit, such that the ratio falls between the upper limit and the lower limit. More specifically, the control device 24 controls the running frequency of the compressor 21 on the basis of the first pressure value and the second pressure value. It is allowable that the control device 24 is not included in the heat-source-side unit 20, but is included in the load-side unit 10. The predetermined upper limit and the predetermined lower limit are values individually set for the compressor 21 to be properly operated.

The heat-source-side unit 20 further includes an accumulator 25 having a function of accumulating refrigerant. Refrigerant in liquid form is stored in the accumulator 25. The compressor 21 suctions and compresses refrigerant in gas form of the refrigerant stored in the accumulator 25. The suction-side detector 22 detects a pressure of refrigerant to be delivered to the accumulator 25.

The heat-source-side unit 20 further includes a heat-source-side heat exchanger 26 that exchanges heat between refrigerant and outside air, and a heat-source-side blower 27 that delivers outside air to the heat-source-side heat exchanger 26. A fan is an example of the heat-source-side blower 27.

The heat-source-side unit 20 further includes a throttle device 28 connected to one of the two end portions of the heat-source-side heat exchanger 26. The throttle device 28 is provided between the load-side heat exchanger 11 and the heat-source-side heat exchanger 26, and adjusts the flow rate of refrigerant flowing between the load-side heat exchanger 11 and the heat-source-side heat exchanger 26 to adjust the temperature of the refrigerant. The throttle device 28 also has a function of decompressing the refrigerant. For example, the throttle device 28 is represented by a linear electronic expansion valve, or is an on-off valve that switches the flow of the refrigerant between on and off by switching the valve between an open state and a closed state.

The heat-source-side unit 20 further includes a flow-path switch 29 connected to the other of the two end portions of the heat-source-side heat exchanger 26. The flow-path switch 29 switches between a heating flow path and a cooling flow path corresponding to the switching between cooling operation and heating operation in the refrigeration cycle device 1. For example, the flow-path switch 29 is a four-way valve. During the heating operation, the flow-path switch 29 connects the compressor 21 on the discharge side and the load-side heat exchanger 11, and connects the heat-source-side heat exchanger 26 and the accumulator 25. During the cooling operation, the flow-path switch 29 connects the compressor 21 on the discharge side and the heat-source-side heat exchanger 26, and connects the load-side heat exchanger 11 and the accumulator 25.

The compressor 21, the flow-path switch 29, the heat-source-side heat exchanger 26, the throttle device 28, the load-side heat exchanger 11, and the accumulator 25 are included in the refrigeration cycle device 1, and form a refrigeration cycle.

Next, the operation of the refrigeration cycle device 1 during cooling operation is described. The compressor 21 compresses refrigerant. The compressed refrigerant flows through the flow-path switch 29 to the heat-source-side heat exchanger 26. The refrigerant having flowed into the heat-source-side heat exchanger 26 dissipates heat to the air. The throttle device 28 decompresses the refrigerant having dissipated the heat. The refrigerant having been decompressed by the throttle device 28 absorbs heat from the air in the load-side heat exchanger 11, and then flows to the flow-path switch 29. The refrigerant having flowed into the flow-path switch 29 is suctioned into the compressor 21 via the accumulator 25.

Figure 2:
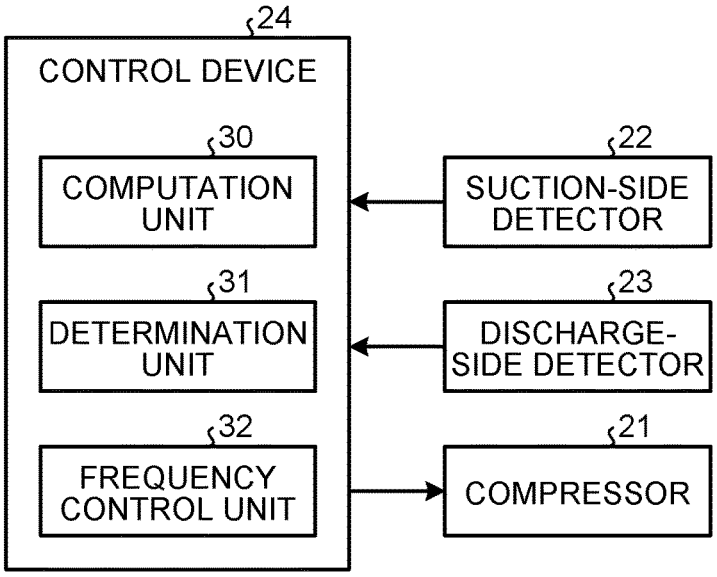
FIG. 2 is a diagram illustrating a configuration of a control device included in the refrigeration cycle device according to the first embodiment.

FIG. 2 is a diagram illustrating a configuration of the control device 24 included in the refrigeration cycle device 1 according to the first embodiment. The control device 24 includes a computation unit 30 that computes the ratio of the second pressure value to the first pressure value. As described above, the first pressure value is a value of pressure detected by the suction-side detector 22, and the second pressure value is a value of pressure detected by the discharge-side detector 23. In general, the first pressure value is smaller than the second pressure value.

The control device 24 includes a determination unit 31 that determines whether the ratio obtained by the computation unit 30 is between the predetermined upper limit and the predetermined lower limit, and a frequency control unit 32 having a function of controlling the running frequency of the compressor 21 on the basis of a determination result obtained by the determination unit 31.

Figure 3:
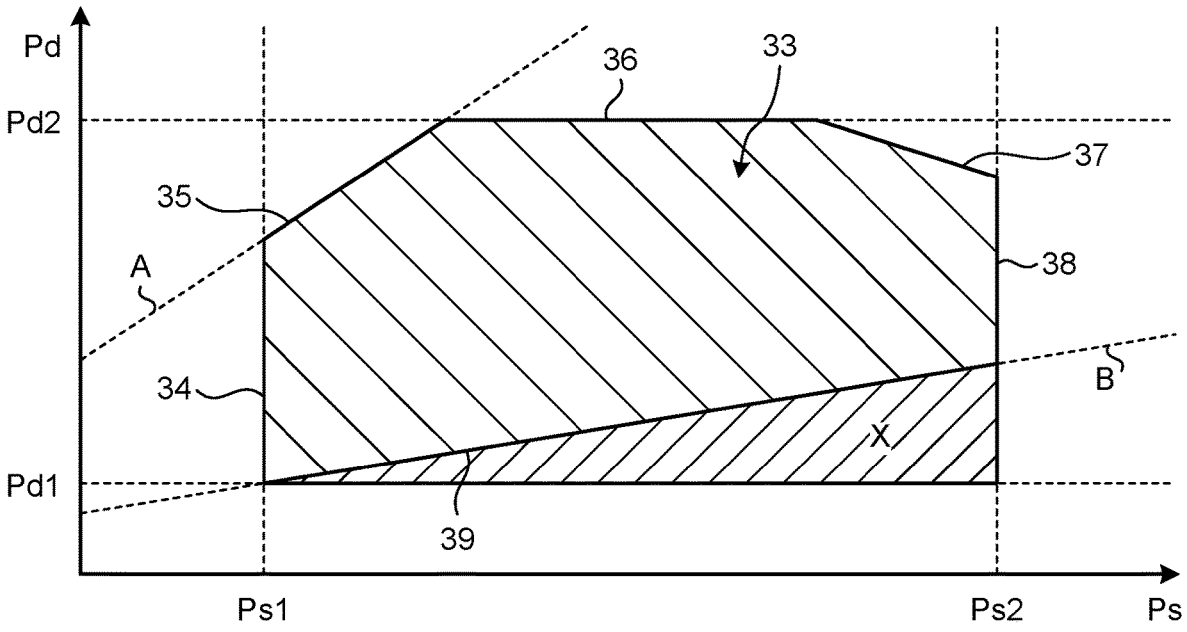
FIG. 3 is a graph for explaining running of a compressor included in the refrigeration cycle device according to the first embodiment.

FIG. 3 is a graph for explaining running of the compressor 21 included in the refrigeration cycle device 1 according to the first embodiment. In FIG. 3, Ps on the horizontal axis indicates the pressure of refrigerant on the suction side of the compressor 21, while Pd on the vertical axis indicates the pressure of refrigerant on the discharge side of the compressor 21. In general, the pressure of refrigerant on the suction side of the compressor 21 is lower than the pressure of refrigerant on the discharge side of the compressor 21. A lower limit of the pressure of refrigerant on the suction side of the compressor 21 is represented as Ps1. An upper limit of the pressure of refrigerant on the suction side of the compressor 21 is represented as Ps2. A lower limit of the pressure of refrigerant on the discharge side of the compressor 21 is represented as Pd1. An upper limit of the pressure of refrigerant on the discharge side of the compressor 21 is represented as Pd2.

The lower limit Ps1 of the pressure of refrigerant on the suction side of the compressor 21, the upper limit Ps2 of the pressure of refrigerant on the suction side of the compressor 21, the lower limit Pd1 of the pressure of refrigerant on the discharge side of the compressor 21, and the upper limit Pd2 of the pressure of refrigerant on the discharge side of the compressor 21 are values conventionally set for the compressor 21 to be operated. That is, conventionally, the compressor 21 is controlled to be operated within a compressor operating range defined by Ps1, Ps2, Pd1, and Pd2. However, even when the compressor 21 operates within the compressor operating range, differential-pressure oil supply to the compressor 21 cannot be properly performed in a region X illustrated in FIG. 3. That is, in the region X, the compressor 21 cannot be properly supplied with oil on the basis of the difference in pressure of refrigerant between the suction side of the compressor 21 and the discharge side of the compressor 21.

In the first embodiment, the control device 24 controls the compressor 21 to be operated within a running range 33 that is a part of the compressor operating range. The running range 33 is a range defined by a boundary 34, a boundary 35, a boundary 36, a boundary 37, a boundary 38, and a boundary 39. In FIG. 3, all the boundaries 34, 35, 36, 37, 38, and 39 are straight lines. However, each of the boundaries 34, 35, 36, 37, 38, and 39 may be, for example, a curved line corresponding to the specifications of the compressor 21 in some cases.

The boundary 34 corresponds to the lower limit Ps1 set for the pressure of refrigerant on the suction side of the compressor 21. The boundary 36 corresponds to the upper limit Pd2 set for the pressure of refrigerant on the discharge side of the compressor 21. The boundary 38 corresponds to the upper limit Ps2 set for the pressure of refrigerant on the suction side of the compressor 21. The boundary 35 corresponds to the predetermined upper limit described above. In FIG. 3, this upper limit is given a reference sign A. The boundary 39 corresponds to the predetermined lower limit described above. In FIG. 3, this lower limit is given a reference sign B. The predetermined upper limit A described above is, for example, "10", while the predetermined lower limit B described above is, for example, "2". The upper limit A and the lower limit B are set in accordance with, for example, the performance and the usage environment of the compressor 21.

When the pressure Ps of refrigerant on the suction side of the compressor 21, and the pressure Pd of refrigerant on the discharge side of the compressor 21 fall within the running range 33, the control device 24 controls the running frequency of the compressor 21 such that the pressure Ps of the refrigerant on the suction side and the pressure Pd of the refrigerant on the discharge side do not fall outside the running range 33. When the pressure Ps of the refrigerant on the suction side or the pressure Pd of the refrigerant on the discharge side falls outside the running range 33, the control device 24 controls the running frequency of the compressor 21 such that the pressure Ps of the refrigerant on the suction side and the pressure Pd of the refrigerant on the discharge side fall within the running range 33.

As the ratio of the pressure of refrigerant discharged from the compressor 21 to the pressure of refrigerant to be suctioned into the compressor 21 becomes higher, there is a larger difference in pressure between refrigerant to be suctioned into the compressor 21 and refrigerant discharged from the compressor 21. In this case, a relatively high thrust load is applied to a shaft of the compressor motor included in the compressor 21. When the difference is relatively large, there is a possibility that heat may be generated since the workload in the compressor motor of the compressor 21 increases, and the heat generation may cause the temperature of the compressor 21 to exceed its allowable temperature. That is, when the ratio is relatively high, there is a risk that an abnormality may occur in the compressor 21. In the first embodiment, when the ratio exceeds the upper limit A, the control device 24 decreases the running frequency of the compressor 21 by a given value so as to reduce stress applied to the compressor 21.

When the ratio is relatively low, differential-pressure oil supply to the compressor 21 cannot be properly performed. In the first embodiment, when the ratio is lower than the lower limit B, the control device 24 increases the running frequency of the compressor 21 by a given value such that differential-pressure oil supply to the compressor 21 can be properly performed.

The boundary 37 is determined by a current for driving the compressor 21. The current for driving the compressor 21 is an inverter current. When the pressure Ps of the refrigerant on the suction side, and the pressure Pd of the refrigerant on the discharge side fall outside the running range 33 with respect to the boundary 37, the compressor 21 operates in an overload running state in which the pressure Ps of the refrigerant on the suction side and the pressure Pd of the refrigerant on the discharge side are both high. That is, when the pressure Ps of the refrigerant on the suction side, and the pressure Pd of the refrigerant on the discharge side fall outside the running range 33 with respect to the boundary 37, the compressor 21 does not operate properly. In the first embodiment, when the drive current for the compressor 21 is limited, the operation of the compressor 21 is limited. That is, the operation of the compressor 21 is limited by control on the basis of a consumption current of the compressor 21.

Figure 4:
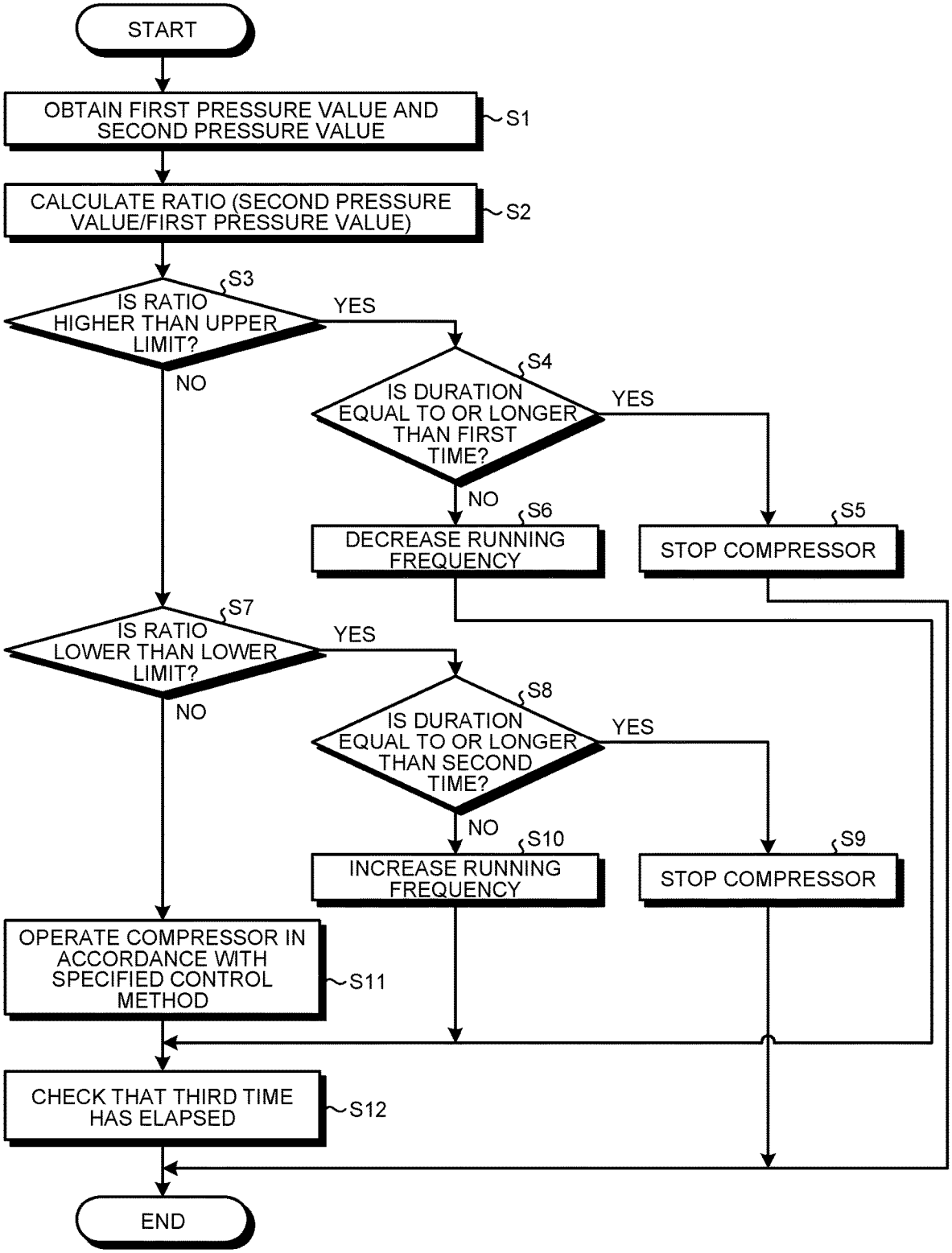
FIG. 4 is a flowchart illustrating an example of an operating procedure for the control device included in the refrigeration cycle device according to the first embodiment.

Next, an example of the operation of the refrigeration cycle device 1 according to the first embodiment is described with reference to FIG. 4. FIG. 4 is a flowchart illustrating an example of an operating procedure for the control device 24 included in the refrigeration cycle device 1 according to the first embodiment. The control device 24 obtains first information that indicates the first pressure value detected by the suction-side detector 22 from the suction-side detector 22, and obtains second information that indicates the second pressure value detected by the discharge-side detector 23 from the discharge-side detector 23 (S1). The first pressure value is a value of the pressure of refrigerant to be suctioned into the compressor 21. The second pressure value is a value of the pressure of refrigerant discharged from the compressor 21.

The control device 24 calculates a ratio of the second pressure value to the first pressure value (S2). The control device 24 determines whether the calculated ratio is higher than the predetermined upper limit (S3). When the control device 24 determines that the calculated ratio is higher than the upper limit (YES at S3), the control device 24 determines whether the state, in which the calculated ratio is higher than the upper limit, lasts for a predetermined first time or longer (S4). In the flowchart in FIG. 4, the description "determines whether the state, in which the calculated ratio is higher than the upper limit, lasts for a predetermined first time or longer" is expressed by the words "IS DURATION EQUAL TO OR LONGER THAN FIRST TIME?"

When the state, in which the calculated ratio is higher than the upper limit, lasts for the first time or longer, there is a possibility that an abnormality has occurred in the compressor 21 or in one or more of the plural constituent elements included in the refrigeration cycle device 1, other than the compressor 21. In view of this, when the control device 24 determines that the state, in which the calculated ratio is higher than the upper limit, lasts for the first time or longer (YES at S4), the control device 24 stops the operation of the compressor 21 (S5).

When the control device 24 determines that the state, in which the calculated ratio is higher than the upper limit, does not last for the first time or longer (NO at S4), the control device 24 decreases the running frequency of the compressor 21 by a predetermined value (S6). When the control device 24 determines that the state, in which the calculated ratio is higher than the upper limit, does not last for the first time or longer (NO at S4), this state lasts for a time shorter than the first time. After having performed the operation at Step S6, the control device 24 performs an operation at S12 described later.

When the control device 24 determines that the calculated ratio is equal to or lower than the predetermined upper limit (NO at S3), the control device 24 determines whether the calculated ratio is lower than the predetermined lower limit (S7). When the control device 24 determines that the calculated ratio is lower than the lower limit (YES at S7), the control device 24 determines whether the state, in which the calculated ratio is lower than the lower limit, lasts for a predetermined second time or longer (S8). In the flowchart in FIG. 4, the description "determines whether the state, in which the calculated ratio is lower than the lower limit, lasts for a predetermined second time or longer" is expressed by the words "IS DURATION EQUAL TO OR LONGER THAN SECOND TIME?"

When the state, in which the calculated ratio is lower than the lower limit, lasts for the predetermined second time or longer, there is a possibility that an abnormality has occurred in the compressor 21 or in one or more of the plural constituent elements included in the refrigeration cycle device 1, other than the compressor 21. In view of this, when the control device 24 determines that the state, in which the calculated ratio is lower than the lower limit, lasts for the predetermined second time or longer (YES at S8), the control device 24 stops the operation of the compressor 21 (S9).

When the control device 24 determines that the state, in which the calculated ratio is lower than the lower limit, does not last for the predetermined second time or longer (NO at S8), the control device 24 increases the running frequency of the compressor 21 by a predetermined value (S10). After having performed the operation at Step S10, the control device 24 performs an operation at S12 described later.

When the control device 24 determines that the calculated ratio is equal to or higher than the predetermined lower limit (NO at S7), the control device 24 operates the compressor 21 in accordance with a specified control method (S11).

At Step S12, the control device 24 checks that a predetermined third time has elapsed since the control device 24 has performed the operation at Step S6, Step S10, or Step S11. The control device 24 performs the operation at Step S12 and thereby ends a series of operations. It is allowable that after having performed the operation at Step S12, the control device 24 performs the operation at Step S1.

As described above, the control device 24 included in the refrigeration cycle device 1 according to the first embodiment determines whether the ratio of the second pressure value detected by the discharge-side detector 23 to the first pressure value detected by the suction-side detector 22 is between the predetermined upper limit and the predetermined lower limit. When the control device 24 determines that the ratio is not between the upper limit and the lower limit, the control device 24 controls the compressor 21 such that the ratio falls between the upper limit and the lower limit. The suction-side detector 22 detects a pressure of refrigerant to be suctioned into the compressor 21. The discharge-side detector 23 detects a pressure of refrigerant discharged from the compressor 21. Due to the above operation, the refrigeration cycle device 1 can properly perform differential-pressure oil supply to the compressor 21.

Further, when an abnormality has occurred in the compressor 21, or when an abnormality has occurred in one or more of the plurality of constituent elements included in the refrigeration cycle device 1, other than the compressor 21, then the control device 24 included in the refrigeration cycle device 1 stops the operation of the compressor 21. That is, the refrigeration cycle device 1 can reduce degradation of the quality of the constituent elements included in the refrigeration cycle device 1, and furthermore can reduce damage of these constituent elements.

In the first embodiment, when an abnormality does not occur in any of the constituent elements included in the refrigeration cycle device 1, the compressor 21 operates in the running range 33. Thus, the refrigeration cycle device 1 according to the first embodiment reduces the time during which stress is applied to the compressor 21, while increasing the time during which differential-pressure oil supply to the compressor 21 can be performed. That is, the refrigeration cycle device 1 has a longer service life than the conventional refrigeration cycle device.

Second Embodiment

Figure 5:
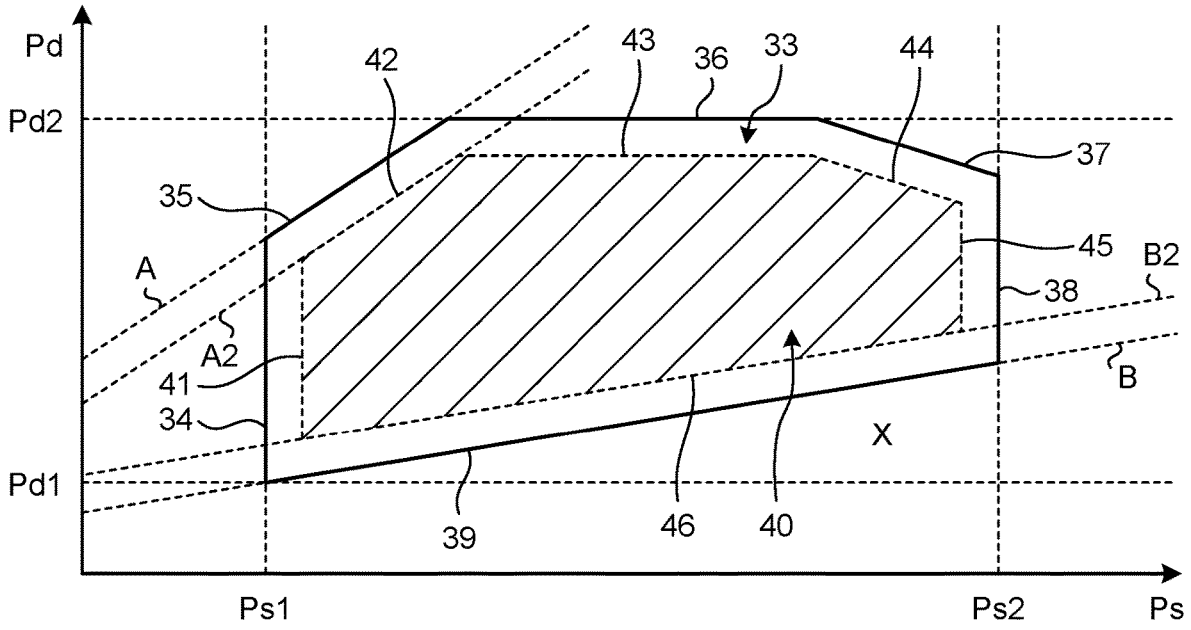
FIG. 5 is a graph for explaining running of a compressor included in a refrigeration cycle device according to a second embodiment.

A refrigeration cycle device according to a second embodiment has an identical configuration to that of the refrigeration cycle device 1 according to the first embodiment. However, the control device 24 according to the second embodiment has functions different from those of the control device 24 according to the first embodiment. In the second embodiment, differences from the first embodiment are mainly described. FIG. 5 is a graph for explaining running of the compressor 21 included in the refrigeration cycle device 1 according to the second embodiment. Elements in FIG. 5 identical to those in FIG. 3 are denoted by like reference signs as those in FIG. 3. Descriptions of the elements in FIG. 5 identical to those in FIG. 3 are omitted.

In the graph in FIG. 5, a frequency control region 40 is provided inside the running range 33. The frequency control region 40 is not illustrated in the graph in FIG. 3. The graph in FIG. 5 is different from the graph in FIG. 3 in that the frequency control region 40 is provided. The frequency control region 40 is a region defined by a boundary 41, a boundary 42, a boundary 43, a boundary 44, a boundary 45, and a boundary 46. In FIG. 5, all the boundaries 41, 42, 43, 44, 45, and 46 are straight lines.

The boundary 41 corresponds to a first value that is larger than the lower limit Ps1 of the pressure of refrigerant on the suction side of the compressor 21 and smaller than the upper limit Ps2 of the pressure of refrigerant on the suction side of the compressor 21. The boundary 43 corresponds to a second value that is smaller than the upper limit Pd2 of the pressure of refrigerant on the discharge side of the compressor 21 and larger than the lower limit Pd1 of the pressure of refrigerant on the discharge side of the compressor 21. The boundary 45 corresponds to a third value that is smaller than the upper limit Ps2 of the pressure on the suction side of the compressor 21 and larger than the first value.

The boundary 42 corresponds to an upper-limit-side second reference value that is smaller than the predetermined upper limit and larger than the predetermined lower limit. In FIG. 5, the upper-limit-side second reference value is given a reference sign A2. The boundary 46 corresponds to a lower-limit-side second reference value that is larger than the predetermined lower limit and smaller than the upper-limit-side second reference value. In FIG. 5, the lower-limit-side second reference value is given a reference sign B2. The upper-limit-side second reference value and the lower-limit-side second reference value are preset values. The boundary 44 is a line provided inside the running range 33 and is parallel to the boundary 37.

In the second embodiment, the control device 24 does not control the compressor 21 when the ratio of the second pressure value to the first pressure value is between the predetermined upper limit A and the upper-limit-side second reference value, or when the ratio is between the predetermined lower limit B and the lower-limit-side second reference value. Specifically, when the ratio is between the predetermined upper limit A and the predetermined lower limit B; however, the ratio is not between the upper-limit-side second reference value and the lower-limit-side second reference value, then the control device 24 according to the second embodiment does not control the running frequency of the compressor 21. The first pressure value is a value of the pressure of refrigerant to be suctioned into the compressor 21. The second pressure value is a value of the pressure of refrigerant discharged from the compressor 21.

Figure 6:
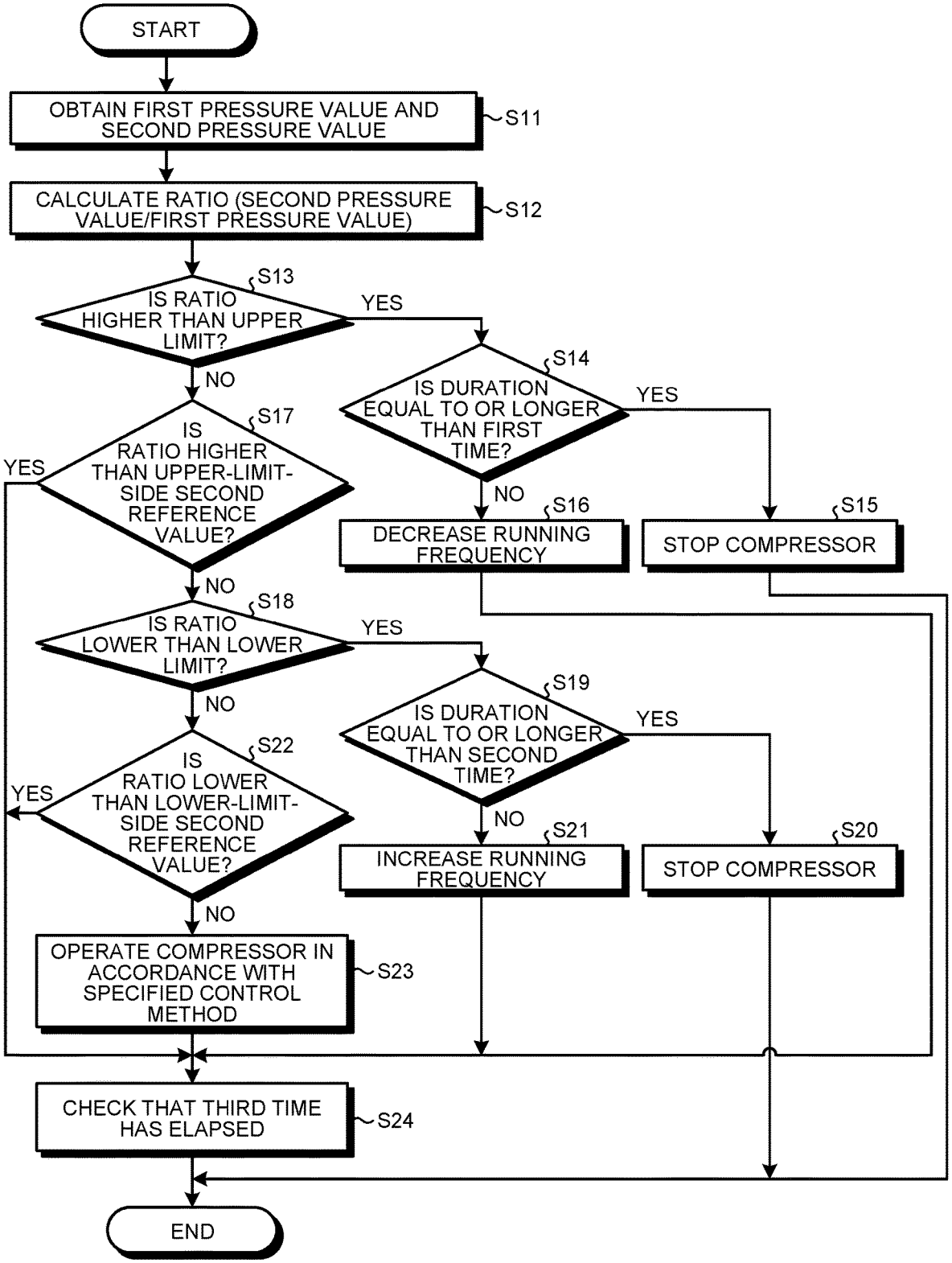
FIG. 6 is a flowchart illustrating an example of an operating procedure for a control device included in the refrigeration cycle device according to the second embodiment.

Next, an example of the operation of the refrigeration cycle device 1 according to the second embodiment is described with reference to FIG. 6. FIG. 6 is a flowchart illustrating an example of an operating procedure for the control device 24 included in the refrigeration cycle device 1 according to the second embodiment. Operations at Steps S11 to S16 in FIG. 6 are the same as those at Steps S1 to S6 in FIG. 4. Therefore, descriptions of the operations at Steps S11 to S16 in FIG. 6 are omitted.

When the control device 24 determines that the calculated ratio is equal to or lower than the predetermined upper limit (NO at S13), the control device 24 determines whether the calculated ratio is higher than the upper-limit-side second reference value (S17). When the control device 24 determines that the calculated ratio is higher than the upper-limit-side second reference value (YES at S17), that is, when the control device 24 determines that the calculated ratio is between the predetermined upper limit and the upper-limit-side second reference value (YES at S17), the control device 24 does not control the running frequency of the compressor 21, and instead performs an operation at Step S24 described later.

When the control device 24 determines that the calculated ratio is not higher than the upper-limit-side second reference value (NO at S17), that is, when the control device 24 determines that the calculated ratio is equal to or lower than the upper-limit-side second reference value (NO at S17), the control device 24 preforms an operation at Step S18. Operations at Steps S18 to S21 in FIG. 6 are the same as those at Steps S7 to S10 in FIG. 4. Therefore, descriptions of the operations at Steps S18 to S21 in FIG. 6 are omitted.

When the control device 24 determines that the calculated ratio is equal to or higher than the lower limit (NO at S18), the control device 24 determines whether the calculated ratio is lower than the lower-limit-side second reference value (S22). When the control device 24 determines that the calculated ratio is lower than the lower-limit-side second reference value (YES at S22), that is, when the control device 24 determines that the calculated ratio is between the predetermined lower limit and the lower-limit-side second reference value (YES at S22), the control device 24 does not control the running frequency of the compressor 21, and instead performs an operation at Step S24 described later.

When the control device 24 determines that the calculated ratio is equal to or higher than the lower-limit-side second reference value (NO at S22), the control device 24 operates the compressor 21 in accordance with a specified control method (S23).

At Step S24, the control device 24 checks that a predetermined third time has elapsed since the control device 24 has performed the operation at Step S16, Step S21, or Step S23, or since the control device 24 has determined that the ratio is higher than the upper-limit-side second reference value at Step S17, or since the control device 24 has determined that the ratio is lower than the lower-limit-side second reference value at Step S22. The control device 24 performs the operation at Step S24 and thereby ends a series of operations. It is allowable that after having performed the operation at Step S24, the control device 24 performs the operation at Step S11.

As described above, when the ratio of the second pressure value to the first pressure value is between the predetermined upper limit A and the predetermined lower limit B; however, the ratio is not between the upper-limit-side second reference value and the lower-limit-side second reference value, then the control device 24 according to the second embodiment does not control the running frequency of the compressor 21. The first pressure value is a value of the pressure of refrigerant to be suctioned into the compressor 21. The second pressure value is a value of the pressure of refrigerant discharged from the compressor 21.

Due to this operation, the refrigeration cycle device 1 according to the second embodiment continues to control the running frequency of the compressor 21 in accordance with a specified control method, and can thereby prevent in advance an occurrence of a state in which the ratio of the second pressure value to the first pressure value is not between the predetermined upper limit A and the predetermined lower limit B.

In a case where the first pressure value and the second pressure value are both present within the compressor operating range, when the control device 24 determines whether the ratio of the second pressure value to the first pressure ratio is between the predetermined upper limit and the predetermined lower limit, and then determines that the ratio is not between the upper limit and the lower limit, the control device 24 may control the running frequency of the compressor 21 such that the ratio falls between the upper limit and the lower limit. The compressor operating range is a range defined by the lower limit Ps1 of the pressure of refrigerant on the suction side of the compressor 21, the upper limit Ps2 of the pressure of refrigerant on the suction side of the compressor 21, the lower limit Pd1 of the pressure of refrigerant on the discharge side of the compressor 21, and the upper limit Pd2 of the pressure of refrigerant on the discharge side of the compressor 21 as illustrated in FIG. 3.

Figure 7:
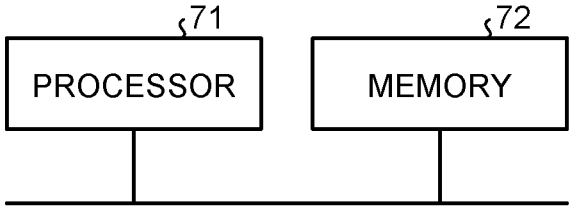
FIG. 7 is a diagram illustrating a processor in a case where the functions of the control device included in the refrigeration cycle device according to the first embodiment are implemented by the processor.

FIG. 7 is a diagram illustrating a processor 71 in a case where the functions of the control device 24 included in the refrigeration cycle device 1 according to the first embodiment are implemented by the processor 71. That is, it is allowable that the functions of the control device 24 are implemented by the processor 71 that executes programs stored in a memory 72. The processor 71 is a Central Processing Unit (CPU), a processing device, a computation device, a microprocessor, or a Digital Signal Processor (DSP). FIG. 7 also illustrates the memory 72.

In a case where the functions of the control device 24 are implemented by the processor 71, these functions are implemented by the processor 71 and by software, firmware, or a combination of the software and the firmware. The software or the firmware is described as programs and stored in the memory 72. The processor 71 reads and executes the programs stored in the memory 72, thereby implementing the functions of the control device 24.

In a case where the functions of the control device 24 are implemented by the processor 71, the refrigeration cycle device 1 includes the memory 72 that stores therein programs with which steps executed by the control device 24 are executed as a result. The programs stored in the memory 72 are also regarded as causing a computer to execute the procedure or the method that is performed by the control device 24.

The memory 72 is a nonvolatile or volatile semiconductor memory such as a Random Access Memory (RAM), a Read Only Memory (ROM), a flash memory, an Erasable Programmable Read Only Memory (EPROM), or an Electrically Erasable Programmable Read-Only Memory (EEPROM) (registered trademark); a magnetic disk; a flexible disk; an optical disk; a compact disk; a mini disk; a Digital Versatile Disk (DVD), or the like.

Figure 8:
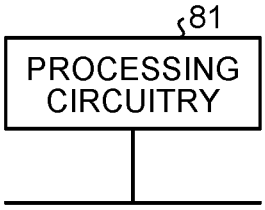
FIG. 8 is a diagram illustrating a processing circuitry in a case where the control device included in the refrigeration cycle device according to the first embodiment is implemented by the processing circuitry.

FIG. 8 is a diagram illustrating a processing circuitry 81 in a case where the control device 24 included in the refrigeration cycle device 1 according to the first embodiment is implemented by the processing circuitry 81. That is, the control device 24 may be implemented by the processing circuitry 81.

The processing circuitry 81 is dedicated hardware. The processing circuitry 81 is, for example, a single circuit, a composite circuit, a programmed processor, a parallel programmed processor, an Application Specific Integrated Circuit (ASIC), a Field-Programmable Gate Array (FPGA), or a combination thereof.

A part of the plural functions of the control device 24 can be implemented by software or firmware, and other parts thereof can be implemented by dedicated hardware. In this manner, the functions of the control device 24 can be implemented by hardware, software, firmware, or a combination thereof.

It is allowable that some or all of the functions of the control device 24 according to the second embodiment are implemented by a processor that executes programs stored in a memory. The processor is similar to the processor 71. The memory is similar to the memory 72, and is configured to store therein programs with which some or all of the steps executed by the control device 24 according to the second embodiment are executed as a result. Some or all of the functions of the control device 24 according to the second embodiment may be implemented by a processing circuitry. The processing circuitry is similar to the processing circuitry 81.

The configurations described in the above embodiments are only examples of the content of the present invention. The configurations can be combined with other well-known techniques, and part of each of the configurations can be omitted or modified without departing from the gist of the present invention.

The invention claimed is:

1. A refrigeration cycle device comprising:

a compressor to compress refrigerant;

a suction-side detector to detect a pressure of the refrigerant to be suctioned into the compressor;

a discharge-side detector to detect a pressure of the refrigerant discharged from the compressor; and a controlling circuitry having a function of controlling the compressor when a ratio of a second pressure value detected by the discharge-side detector to a first pressure value detected by the suction-side detector is not between a predetermined upper limit and a predetermined lower limit, such that the ratio falls between the predetermined upper limit and the predetermined lower limit, wherein when the ratio is higher than the predetermined upper limit and a state, in which the ratio is higher than the predetermined upper limit, lasts for at least a predetermined first time, the controlling circuitry stops an operation of the compressor, when the ratio is higher than the predetermined upper limit and the state, in which the ratio is higher than the predetermined upper limit, does not last for at least the predetermined first time, the controlling circuitry decreases a running frequency of the compressor, when the ratio is lower than the predetermined lower limit and a state, in which the ratio is lower than the predetermined lower limit, lasts for at least a predetermined second time, the controlling circuitry stops the operation of the compressor, when the ratio is lower than the predetermined lower limit and the state, in which the ratio is lower than the predetermined lower limit, does not last for at least the predetermined second time, the controlling circuitry increases the running frequency of the compressor, and the controlling circuitry does not control the running frequency of the compressor when the ratio is between the predetermined upper limit and an upper-limit-side second reference value, and when the ratio is between the predetermined lower limit and a lower-limit-side second reference value, the upper-limit-side second reference value being smaller than the predetermined upper limit and larger than the predetermined lower limit, and the lower-limit-side second reference value being larger than the predetermined lower limit and smaller than the upper-limit-side second reference value.

2. The refrigeration cycle device according to claim 1, wherein the controlling circuitry is further configured to calculate the ratio of the second pressure value to the first pressure value.

3. The refrigeration cycle device according to claim 1, wherein the controlling circuitry is further configured to begin a series of operations of the refrigeration cycle device;

end the series of operations responsive to a determination that a third predetermined time for ending operation has elapsed since the controlling circuitry performed one or more of decreasing running frequency of the compressor, increasing running frequency of the compressor, and operating the compressor in accordance with a specified control method.

* * * * *